United States Patent [19]

Nakamura et al.

[11] 4,312,940

[45] Jan. 26, 1982

[54] PHOTOGRAPHIC MATERIAL CONTAINING A NOVEL POLYMER MORDANT

[75] Inventors: Taku Nakamura; Shigeru Nagatomo, both of Minami-ashigara, Japan

[73] Assignee: Fuji Photo Film Co., Ltd., Kanagawa, Japan

[21] Appl. No.: 166,290

[22] Filed: Jul. 7, 1980

Related U.S. Application Data

[63] Continuation-in-part of Ser. No. 71,617, Aug. 31, 1979, abandoned.

[30] Foreign Application Priority Data

Aug. 31, 1978 [JP] Japan ..... 53-106851

[51] Int. Cl.[3] ..... G03C 1/84

[52] U.S. Cl. ..... 430/510; 430/518; 430/941; 430/213; 430/536; 430/537; 526/258; 526/265; 526/310; 525/329; 525/336

[58] Field of Search ..... 430/518, 941, 213, 510, 430/514, 512, 627, 630, 495, 537, 536, 523; 526/258, 265, 310; 525/329, 336

[56] References Cited

U.S. PATENT DOCUMENTS

| | | | |
|---|---|---|---|
| 3,625,694 | 12/1971 | Cohen et al. | 430/518 |
| 3,788,855 | 1/1974 | Cohen et al. | 430/518 |
| 3,898,088 | 8/1975 | Cohen et al. | 430/518 |
| 3,948,663 | 4/1976 | Shiba et al. | 430/518 |
| 3,958,995 | 5/1976 | Campbell et al. | 430/518 |
| 4,038,082 | 7/1977 | Yoshida et al. | 430/213 |
| 4,193,800 | 3/1980 | Iwama et al. | 430/213 |

*Primary Examiner*—Won H. Louie, Jr.
*Attorney, Agent, or Firm*—Sughrue, Mion, Zinn, Macpeak & Seas

[57] ABSTRACT

A photographic light-sensitive material comprising at least one layer containing a polymer dispersion of the following formula (I) or (II) as a mordant (I)

(II)

wherein A represents a monomer unit obtained from at least one monomer having at least two copolymerizable ethylenically unsaturated groups at least one of which is in the side chain; B represents a monomer unit obtained from at least one copolymerizable monoethylenically unsaturated monomer; $D^{\oplus}$ represents a 5- or 6-membered heterocyclic group containing one or two nitrogen atoms one of which is positively charged and D may contain one or more substituents; $R_1$ represents a hydrogen atom or a lower alkyl group; $R_2$ and $R_3$, which may be the same or different, each represents an alkyl group or an aralkyl group, or $R_2$ and $R_3$ may combine together with the nitrogen atom to which they are attached and form a 5- or 6-membered ring; $X^{\ominus}$ represents an anion; Q represents an alkylene group, a phenylene group, an aralkylene group or a group of the formula wherein Y represents an alkylene group or an aralkylene group and R represents an alkyl group; and x, y and z represent the molar percentage of the respective units in the polymer and x is about 0.5 to 10%, y is about 0 to 60% and z is about 30 to 99.5%.

17 Claims, No Drawings

PHOTOGRAPHIC MATERIAL CONTAINING A NOVEL POLYMER MORDANT

CROSS REFERENCE OF THE RELATED APPLICATION

This application is a continuation-in-part of application Ser. No. 71,617 filed Aug. 31, 1979, abandoned.

BACKGROUND OF THE INVENTION

1. Field of the Invention

The present invention relates to a novel polymer dispersion which is useful as a mordant for dyes used in photographic systems and to a photographic system containing a layer of this polymer dispersion.

2. Description of the Prior Art

It has heretofore been known in the photographic art to provide a layer which absorbs excess light in a photographic material in order to prevent halation and improve the sharpness of the resulting image. For example, it is known to provide an antihalation layer beneath the support, to provide an antihalation layer between the support and a light-sensitive layer, to provide an antihalation layer(s) between light-sensitive layers, etc.

These antihalation layers and anti-irradiation layers generally contain light-absorbing materials such as dyes, carbon black, colloidal silver, etc. However, these materials when used in a photosensitive layer or a layer adjacent to a photosensitive layer adversely affect photographic properties. For example, they cause desensitization, increase fogging, etc. In other words, when an antihalation layer containing a dye is provided adjacent a photosensitive layer, the dye by diffusion into the photosensitive layer absorbs the light necessary for exposure and thus brings about desensitization. When colloidal silver is used it increases fogging in the adjacent photosensitive layer.

In order to prevent the deterioration of photographic properties by such dye diffusion, a technique has been developed to prevent diffusion by mordanting the dye using various polymers as dye mordants. However, when the polymer mordants described in, e.g., U.S. Pat. No. 2,326,057, etc., are added to an antihalation layer or an anti-irradiation layer to prevent dye diffusion, the adhesion with the adjacent emulsion layer deteriorates remarkably, which sometimes results in peeling of coated layers under conditions such as encountered during development, etc. Further, polymer mordants having a guanylhydrazone of a keto group structure such as described in, e.g., U.S. Pat. Nos. 2,882,156 and 3,740,228, Japanese Patent Publication No. 15820/1974, etc., require a large amount of organic solvent for their production which in turn complicates their use. The mordants of this type also deteriorate adhesion with the adjacent emulsion layer, if used in a large amount to prevent the diffusion of dye.

In multilayered photographic systems, the adhesion between layers is extremely important, and as a result there has been a demand for the development of a mordant which has excellent mordant properties and, at the same time, does not deteriorate the adhesion between layers when incorporated in a photographic system which can be produced easily.

A mordanted dye must be fixed in a photographic material before a development processing and, also, the mordanted dye must be removed out from the photographic material into a development processing solution during a development processing. Because, if the dye remains in the photographic material after the development processing, the dye causes stain in the resulting processed photographic material. However, polymer mordants described in U.S. Pat. No. 3,958,995 strongly mordant the dye during the development processing and, thus, the dye is not substantially removed out from the photographic material into the processing solution. Thus, in the case of the polymer mordants above, it is necessary to decolorize the dye during the development processing, although it is impossible to completely decolorize the dye during the development processing. Thus, it has been damanded to obtain a mordant which is capable of fixing a dye in a photographic material before development processing and capable of removing the dye during the development processing.

SUMMARY OF THE INVENTION

Accordingly, an object of the present invention is to provide a novel polymer dispersion having excellent mordant properties.

Another object of the present invention is to provide a mordant which does not deteriorate the adhesion between layers when incorporated in a photographic system.

Still another object of the present invention is to provide a polymer mordant which can be produced easily in the same reaction vessel without using an organic solvent.

A further object of the present invention is to provide a photographic material containing a mordant capable of mordanting a dye in the photographic material before a development processing and capable of completely releasing the mordanted dye from the photographic material into the development processing solution during the development processing.

The above objects have been accomplished using a polymer of the formula (I) or (II) as a mordant.

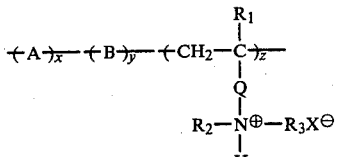

(I)

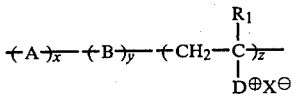

(II)

Where A represents a monomer unit obtaned from at least one copolymerizable monomer having at least two copolymerizable ethylenically unsaturated groups at least one of which is in the side chain, B represents a monomer unit obtained from a copolymerizable monoethylenically unsaturated monomer, and $D^{\oplus}$ represents a 5- or 6-membered heterocyclic ring having one or two nitrogen atoms one of which is positively charged and D may contain one or more alkyl groups, e.g., a methyl group, as a substituent.

DETAILED DESCRIPTION OF THE INVENTION

In a preferred polymer dispersion in accordance with the present invention, in the above formula monomer A contains 4 to 20 carbon atoms and includes monomers such as divinylbenzene, ethylene glycol dimethacrylate, diethylene glycol dimethacrylate, triethylene glycol dimethacrylate, ethylene glycol diacrylate, diethylene glycol diacrylate, 1,6-hexanediol diacrylate, neopentyl glycol dimethacrylate, tetramethylene glycol dimethacrylate, allylacrylate, N,N'-methylenebisacrylamide, and vinylmethacrylate, etc. Among these, divinylbenzene and ethylene glycol dimethacrylate are especially preferred.

The monoethylenically unsaturated monomer forming B contains 3 to 20 carbon atoms and includes monomers such as α-olefins having 3 to 6 carbon atoms (e.g., ethylene, propylene, 1-butene, isobutene), styrene, α-methylstyrene, vinyltoluene, monoethylenically unsaturated esters of aliphatic acids having 2 to 6 carbon atoms (e.g., vinyl acetate and allyl acetate), esters of ethylenically unsaturated carboxylic acids having 3 to 20 carbon atoms or dicarboxylic acids having 3 to 20 carbon atoms (e.g., methyl methacrylate, ethyl methacrylate, n-butyl methacrylate, n-hexyl methacrylate, cyclohexyl methacrylate, benzyl methacrylate, n-butyl acrylate, n-hexyl acrylate and 2-ethylhexyl acrylate), acrylonitrile, allyl cyanide, etc. Among these, styrene, n-butyl methacrylate, cyclohexyl methacrylate, etc., are especially preferred. B may contain two or more of the above monomer units.

Examples of $D^+$ include the following:

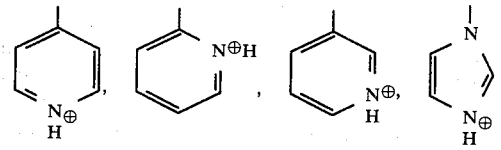

$R_1$ represents a hydrogen atom or a lower straight chain alkyl group having 1 to 6 carbon atoms (e.g., a methyl group, an ethyl group, an n-propyl group, an n-butyl group, an n-amyl group and as an n-hexyl group), and among these a hydrogen atom and a methyl group are especially preferred.

Q represents a divalent alkylene group having 1 to 12 carbon atoms (e.g., a methylene group, a hexamethylene group), a phenylene group, an aralkylene group having 7 to 12 carbon atoms

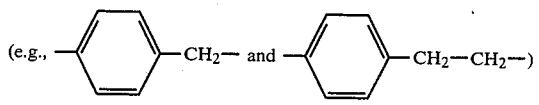

or a a group of the formula:

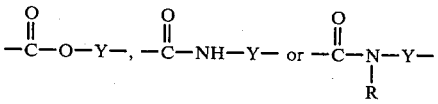

wherein Y represents an alkylene group having 1 to 6 carbon atome (e.g., ethylene, hexamethylene, etc.) or an aralkylene group having 7 to 12 carbon atoms

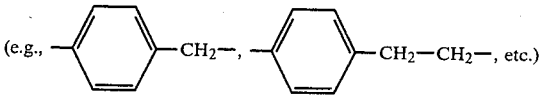

and R represents a straight, branched or cyclic alkyl group having 1 to 6 carbon atoms (e.g., n-propyl, n-butyl, isopropyl, sec-butyl, 2-ethylhexyl, cyclohexyl).

$R_2$ and $R_3$, which may be the same or different, each represents a straight, branched or cyclic alkyl group having 1 to 20 carbon atoms (e.g., n-propyl, n-butyl, isopropyl, sec-butyl, 2-ethylhexyl, cyclohexyl) or a mono- or bicyclic aralkyl group having 7 to 20 carbon atoms. The alkyl group and the aralkyl group include a substituted alkyl group and a substituted aralkyl group, respectively.

$R_2$ and $R_3$ when taken together with the nitrogen atom to which they are attached may form a 5- or 6-membered ring. These rings may contain hetero atoms in addition to the nitrogen atom such as an additional nitrogen, oxygen or sulfur atom. Examples of the ring structure which is formed by $R_2$ and $R_3$ taken together with the nitrogen atom to which they are attached include pyrrolidine, piperidine, morpholine, etc.

Examples of the unsubstituted alkyl group are a methyl group, an ethyl group, an n-propyl group, an isopropyl group, an n-butyl group, an isobutyl group, a t-butyl group and n-amyl group, an isoamyl group, an n-hexyl group, a cyclohexyl group, an n-heptyl group, an n-octyl group, a 2-ethylhexyl group, an n-nonyl group, an n-decyl group, an n-dodecyl group, etc. The number of carbon atoms in the alkyl group is preferably 1 to 6.

The alkyl group may be substituted by an alkoxy group, a cyano group, a halogen atom or an alkoxycarbonyl group. Examples of the substituted alkyl group are an alkoxyalkyl group (e.g., methoxymethyl group, methoxyethyl group, methoxybutyl group, ethoxyethyl group, ethoxypropyl group, ethoxybutyl group, butoxyethyl group, butoxypropyl group, butoxybutyl group and vinyloxyethyl group), a cyanoalkyl group (e.g., 2-cyanoethyl group, 3-cyanopropyl group and 4-cyanobutyl group), a halogenated alkyl group (e.g., 2-fluoroethyl group, 2-chloroethyl group and 3-fluoropropyl group), an alkoxycarbonylalkyl group (e.g., ethoxycarbonylmethyl group, etc.), an allyl group, a 2-butenyl group, a propargyl group, etc.

Examples of the aralkyl group, particularly the unsubstituted aralkyl group are a benzyl group, a phenethyl group, a diphenylmethyl group, a naphthylmethyl group, etc., and examples of the substituted aralkyl group are an alkylaralkyl group (e.g., 4-methylbenzyl group, 2,5-dimethylbenzyl group and 4-isopropylbenzyl group), an alkoxyaralkyl group (e.g., 4-methoxybenzyl group, 4-ethoxybenzyl group and 4-(4-methoxyphenyl)-benzyl group), a cyanoaralkyl group (e.g., 4-cyanobenzyl group and 4-(4-cyanophenyl)benzyl group), a perfluoroalkoxyaralkyl group (e.g., 4-pentafluoropropoxybenzyl group and 4-undecafluorohexyloxybenzyl group), a halogenated aralkyl group (e.g., 4-chlorobenzyl group, 4-bromobenzyl group, 3-chlorobenzyl group, 4-(4-chlorophenyl)benzyl group and 4-(4-bromophenyl)benzyl group), etc. The number of carbon atoms in the aralkyl group is preferably 7 to 14. Among these, a benzyl group is especially preferred.

$X^\ominus$ represents an anion such as a halogen ion (e.g., a chlorine ion and a bromine ion), an alkyl- or aryl-sulfonate ion (e.g., of methanesulfonic acid, ethanesulfonic acid, benzenesulfonic acid and p-toluenesulfonic acid), an acetate ion, a nitrate ion, a sulfate ion, a phosphate ion, etc. Among these, a chlorine ion, an acetate ion and a nitrate ion are especially preferred.

x is about 0.5 to 10 mol%, preferably about 3.0 to 10.0 mol%, y is about 0 to 60 mol%, preferably about 0 to 55 mol% and z is about 30 to 99.5 mol%, preferably about 40 to 97 mol%.

The polymer mordant of the formula (I) in accordance with the present invention can be obtained by emulsion-polymerizing the copolymerizable monomer having at least two ethylenically unsaturated groups as defined above, the monoethylenically unsaturated monomer as defined above and an unsaturated monomer of the formula:

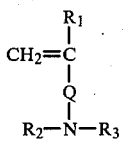

wherein $R_1$, $R_2$, $R_3$ and Q are as defined above; and subsequently treating with an acid of the formula: H—X wherein X is as defined above (e.g., hydrochloric acid, nitric acid, benzenesulfonic acid, p-toluenesulfonic acid or acetic acid) to form a tertiary amine salt of the resulting copolymer. Examples of the above monomer include N,N-dimethylaminoethyl methacrylate, N,N-diethylaminoethyl methacrylate, N,N-dimethylaminoethyl acrylate, N,N-diethylaminoethyl acrylate, N-(N,N-dimethylaminopropyl) acrylamide, N-(N,N-dihexylaminomethyl) acrylamide, 3-(4-pyridyl)propyl acrylate, N,N-dimethylaminomethylstyrene, 2-vinylpyridine or 4-vinylpyridine, and preferably N,N-diethylaminoethyl methacrylate or N,N-dimethylaminomethylstyrene.

Further, the polymer mordant of the formula (I) in accordance with the present invention can also be obtained by emulsion-polymerizing the copolymerizable monomer having at least two ethylenically unsaturated groups as defined above, the monoethylenically unsturated monomer as defined above and an unsaturated monomer of the formula:

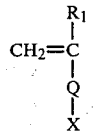

wherein $R_1$, Q and X are as defined above (e.g., β-chloroethylmethacrylate, β-p-toluenesulfonylethyl methacrylate or chloromethyl styrene) and subsequently treating with a secondary amine of the formula:

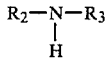

wherein $R_2$ and $R_3$ are as defined above (e.g., dimethylamine, diethylamine, diisopropylamine, morpholine or piperazine) to form a tertiary amine salt of the resulting copolymer.

The above emulsion-polymerization is conducted in the presence of at least one emulsifier selected from anionic surfactants (e.g., Toriton 770 commercially available from Rohm & Haas), cationic surfactants (e.g., octadecyltrimethyl ammonium chloride), nonionic surfactants (e.g., Emulex NP-20 commercially available from Nippon Emulsion, Japan), gelatin, polyvinyl alcohol, etc.; and a free radical polymerization initiator (e.g., a combination of potassium persulfate and sodium hydrogensulfite, and 2,2'-Azobis(2-amidinopropane)hydrochloride, a water soluble azo compound, V-50 (Wako Junyaku, Japan) at a temperature of generally about 30° to about 100° C., preferably about 40° to about 80° C.

The above reaction to form the tertiary amine salt is generally carried out at a temperature of about −10° C. to about 40° C., and the temperature range of about 0° to 30° C. is preferred.

The polymer dispersions in accordance with the present invention can be produced very easily in a single reaction vessel throughout the entire production steps and there is no need of using a large amount of solvent.

Examples and preparations of the polymer dispersions in accordance with the present invention will be given as follows.

Mordant 1

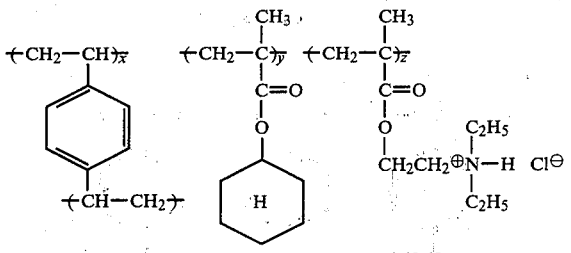

x:y:z = 4:48:48

-continued
Mordant 2
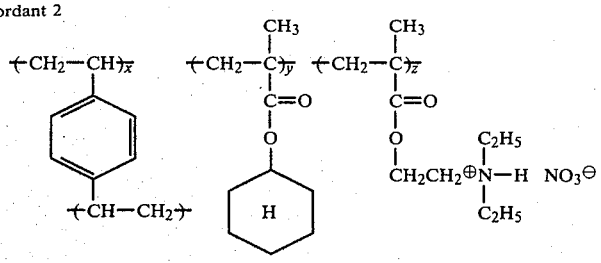
x:y:z = 4:48:48
Mordant 3
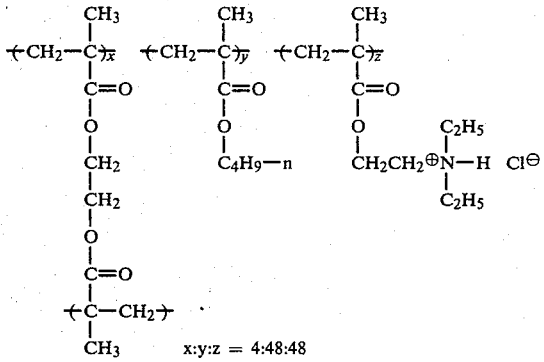
x:y:z = 4:48:48
Mordant 4
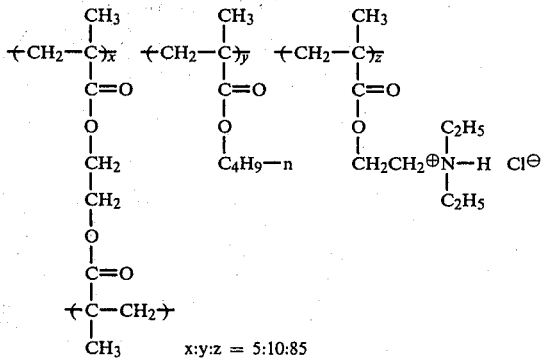
x:y:z = 5:10:85
Mordant 5
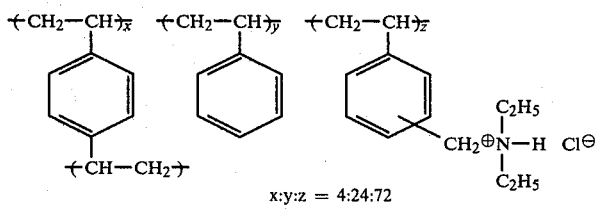
x:y:z = 4:24:72
Mordant 6
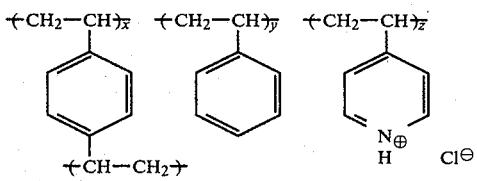
x:y:z = 4:48:48
Mordant 7

-continued

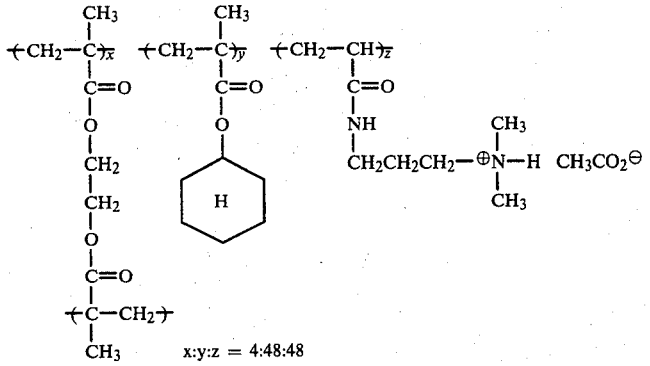

x:y:z = 4:48:48

Mordant 8

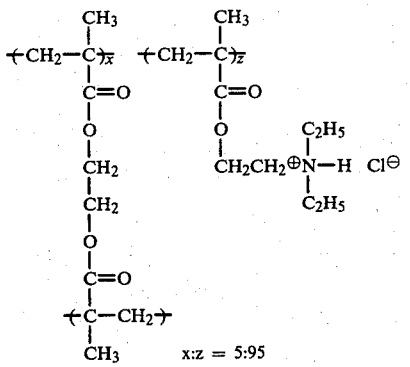

x:z = 5:95

SYNTHESIS EXAMPLE 1

Preparation of poly(divinylbenzene-co-cyclohexyl methacrylate-co-N,N-diethyl-N-methacryloyloxyethyl ammonium hydrochloride) polymer dispersion (Mordant 1)

To a reactor was added 108 g of distilled water, and the reactor was deaerated by nitrogen gas and heated to 60° C. under nitrogen stream. Thereafter, 7.9 g of octadecyl trimethyl ammonium chloride (23%), 0.04 g of polyvinyl alcohol (saponification value 95%), 16.8 g of cyclohexyl methacrylate, 18.5 g of N,N-diethylaminoethyl methacrylate and 0.98 g of divinylbenzene were added thereto and stirred. A solution of 0.44 g of potassium persulfate dissolved in 9.3 g of distilled water deaerated by nitrogen gas and a solution of 0.14 g of sodium hydrogensulfite dissolved in 1.5 g of distilled water deaerated by nitrogen gas were simultaneously added and the stirring was continued for about 5 hours. After being allowed to cool to room temperature, 100 g of distilled water and 10.6 g of concentrated hydrochloric acid were added and filtered to obtain a polymer dispersion having 15.3% by weight of solids and an amine content of $3.09\times10^{-4}$ eq/g.

SYNTHESIS EXAMPLE 2

Preparation of poly(divinylbenzene-co-cyclohexyl methacrylate-co-N,N-diethyl-N-methacryloyloxyethyl ammonium nitrate) polymer dispersion (Mordant 2)

In a similar manner as in Preparation 1, a polymer dispersion having 17.7% by weight of solids and an amine content of $3.05\times10^{-4}$ eq/g was prepared. Here, the acid added was 10.9 g of concentrated nitric acid instead of 10.6 g of concentrated hydrochloric acid of Preparation 1.

SYNTHESIS EXAMPLE 3

Preparation of poly(ethylene glycol dimethacrylate-co-butyl methacrylate-co-N,N-diethyl-N-methacryloyloxyethyl ammonium hydrochloride) polymer dispersion (Mordant 3)

To a reactor was added 800 g of distilled water and it was deaerated by nitrogen gas. Thereafter, 4.1 g of an emulsifier (Emulex NP-20 commercially available from Nippon Emulsion, Japan), 6.4 g of ethylene glycol dimethacrylate, 56.8 g of n-butyl methacrylate and 74 g of N,N-diethylaminoethyl methacrylate were added thereto and stirred. After heating to 75° C., 1.4 g of V-50 of the formula below was added and the stirring was continued for 3 hours. After allowed to cool to room temperature, 340 g of distilled water and 34 g of concentrated hydrochloric acid were added and filtered to obtain a polymer dispersion having 12.0% by weight of solids and an amine content of $2.59\times10^{-4}$ eq/g.

V-50

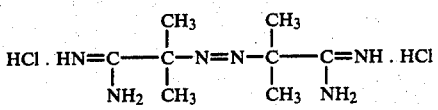

SYNTHESIS EXAMPLE 4

Preparation of poly(ethylene glycol dimethacrylate-co-butyl methacrylate-co-N,N-diethyl-N-methacryloyloxyethyl ammonium hydrochloride) polymer dispersion (Mordant 4)

To a reactor were added 7.8 g of gelatin and 1.2 g of the emulsifier used in Preparation 3, Emulex NP-20 (manufactured by Nippon Emulsion Co., Japan) and 265 g of distilled water was added and heated to dissolve, after which 2.8 g of ethylene glycol dimethacrylate, 2.8 g of butyl methacrylate, 33.3 g of N,N-diethylaminoethyl methacrylate and 10 ml of a 2% aqueous solution of sodium bicarbonate were added and stirred. After heated to 75° C., 0.7 g of the initiator used in Preparation 3, V-50 was added and the stirring was continued for 3 hours. After being allowed to cool to room temperature, 28 g of distilled water and 15.7 g of concentrated hydrochloric acid were added and filtered to obtain a polymer dispersion having 15.5% by weight of solids and an amine content of $4.5\times10^{-4}$ eq/g.

SYNTHESIS EXAMPLE 5

Preparation of poly(divinylbenzene-co-styrene-co-N,N-diethylaminomethylstyrene hydrochloride) polymer dispersion (Mordant 5)

To a reactor were added 2.8 g of an emulsifier, Nissan Trux H-45 (manufactured by Nippon Oils and Fats Co., Ltd., Japan), 75 g of distilled water, 0.8 g of divinylbenzene, 4.1 g of styrene and 17.9 g of chloromethylstyrene and the mixture was stirred. After heating to 60° C., 0.2 g of potassium persulfate and 0.05 g of sodium hydrogensulfite were added and the stirring was continued for three hours. Thereafter, the mixture was cooled to 40° C., 108 g of distilled water and 62 g of isopropyl alcohol were added, after which 8.2 g of diethylamine was added dropwise over 15 minutes, stirred at 40° C. for 2 hours and filtered to obtain a polymer dispersion having 11.2% by weight of solids and an amine content of $3.58\times10^{-4}$ eq/g.

SYNTHESIS EXAMPLE 6

Preparation of poly(ethylene glycol dimethacrylate-co-N,N-diethyl-N-methacryloyloxyethyl ammonium hydrochloride) polymer dispersion (Mordant 8)

To a reactor were added 15.5 g of an emulsifier, Diapon L (manufactured by Nippon Oils and Fats Co., Japan) and 489 g of distilled water and heated to dissolve, after which 5.0 g of ethylene glycol dimethacrylate and 87.9 g of N,N-diethylaminoethyl methacrylate were added and stirred. After heated to 75° C., 0.45 g of the initiator used in Preparation 3, V-50 was added and the stirring was continued for 3 hours. After being allowed to cool to room temperature, 49.5 g of concentrated hydrochloric acid was added and filtered to obtain a polymer dispersion having 16.5% by weight of solids and an amine content of $7.1\times10^{-4}$ eq/g.

The mordants in accordance with the present invention can be incorporated in photographic materials as mordants for filter layer dyes or for antihalation layer dyes by adding each polymer dispersion to an aqueous gelatin solution, adding an appropriate dye thereto and coating the mixture on a support or a photosensitive layer as a filter layer.

In this case, the filter layer can further contain general photographic additives, such as surfactant(s), film hardener(s), stabilizer(s) and the like.

The amount of the polymer dispersion mordant according to the present invention used varies depending on the kind of photographic material, the purpose of application and the kind of the layer to which the mordant is applied, but it is preferred to use about 2 to 100 g of mordant per 100 g of dry gelatin with the preferred amount of dye to be mordanted being about 1 to 20 g per 100 g dry gelatin.

The dyes which can be mordanted by using the present invention include acid dyes (e.g., dyes having a sulfonyl group, a carboxyl group, a sulfonamido group, a phenolic hydroxyl group, etc.), among which acid dyes having sulfonyl group or carboxyl group are preferred, and their representative examples are as follows:

Dye (1)

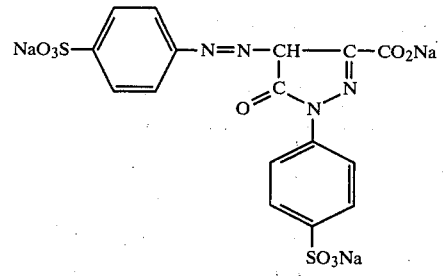

Dye (2)

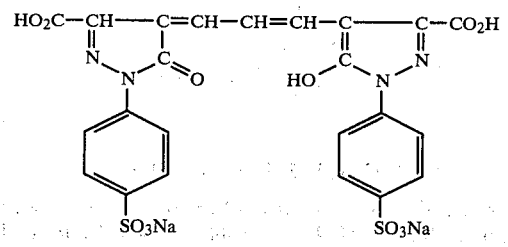

Dye (3)

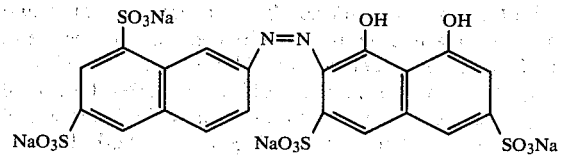

Dye (4)

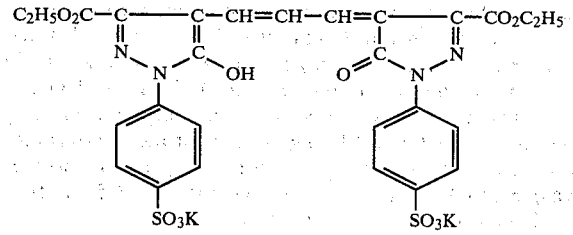

Dye (5)

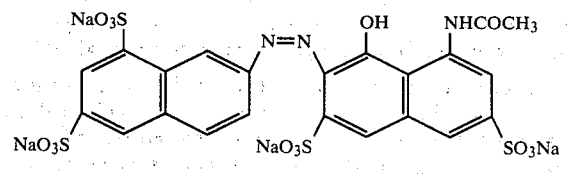

-continued

Dye (6)

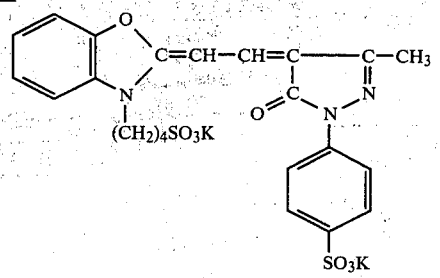

Dye (7)

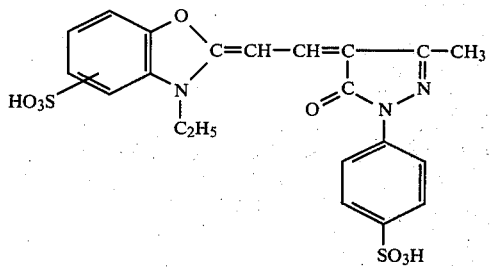

Dye (8)

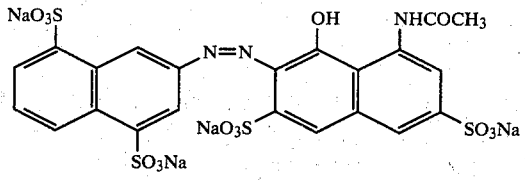

The present invention will be more particularly described by the following Examples.

EXAMPLES 1-11

To 84 ml of a 10% aqueous gelatin solution was added 28 ml of a 2% aqueous solution of the Dye (2), followed by the addition of the mordants prepared in the foregoing Synthesis Examples by changing the kind, concentration and amount respectively as indicated in Table 1, after which distilled water was added to make the total volume 260 ml. Undercoated triacetate fiber films were coated with the solutions respectively so as to give a thickness after drying of about 2.4μ and dried, after which each film was coated with a green light sensitive emulsion layer and a gelatin layer successively to give a set of samples.

COMPARISON EXAMPLES 1-5

In order to determine the effect of the mordants in accordance with the present invention, a set of samples were produced by repeating the procedures in Examples above except that the mordants were replaced by polymer mordants of the formulae (III) and (IV) below as indicated in Table 1.

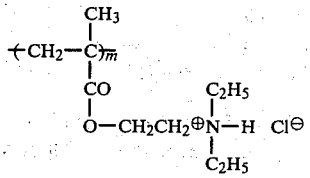

(III)

-continued

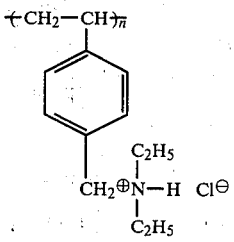

(IV)

TABLE 1

| Sample | Mordant Kind | Mordant Concentration (wt %) | Mordant Amount Added (ml) | Adhesion (peeled off area) (%) |
|---|---|---|---|---|
| Example 1 | Mordant 3 | 4.9 | 56 | 0 |
| 2 | " | 9.8 | 56 | 0 |
| 3 | " | 9.8 | 84 | 0 |
| 4 | Mordant 4 | 3.1 | 56 | 0 |
| 5 | " | 4.1 | 84 | 0 |
| 6 | " | 6.2 | 84 | 0 |
| 7 | Mordant 8 | 16.5 | 10 | 0 |
| 8 | " | 16.5 | 20 | 0 |
| Comparison Example 1 | Formula (III) | 3.1 | 42 | 100 |
| 2 | " | 4.6 | 56 | 74 |
| 3 | " | 6.2 | 84 | 32 |
| Example 9 | Mordant 5 | 4.3 | 43 | 0 |
| 10 | " | 8.9 | 42 | 0 |
| 11 | " | 8.9 | 84 | 0 |
| Comparison Example 4 | Formula (IV) | 7.3 | 39 | 89 |
| 5 | " | 7.3 | 59 | 85 |

As for the samples obtained in Examples 1 to 11 and Comparison Examples 1 to 5, the adhesion was determined for each sample by making fifty squares (1 cm×1 cm) on the coated surface with a knife, sticking a polyester adhesive tape (manufactured by Nitto Electric Industry Co., Ltd., Japan) thereto and measuring the removed area on the surface by the adhesive tape on peeling.

The results of the test on adhesion are given in Table 1. As is evident from the data in Table 1, when Examples 1 to 8 and Comparison Examples 1 to 3 or Examples 9 to 11 and Comparison Examples 4 to 5 are compared, it can be seen that even if the polymer mordant has the same kind of tertiary amine salt, the layer containing a water-soluble polymer mordant as in Comparison Examples has poor adhesion with the emulsion layer and is easily peeled off with the adhesive tape. In contrast, the layer containing the polymer dispersion mordant in accordance with the present invention as in Examples still keeps an excellent adhesion with the emulsion layer and is not peeled off with the adhesive tape even when the amount added becomes larger, and it was observed that in the case of the polymer mordants having the same tertiary amine salt structure the adhesion was greatly improved by emulsion dispersing the polymer mordants.

With all the samples obtained in Examples 1 to 11, the dyes employed were removed during the development treatment to become transparent. Further, there was no increase in fogging, desensitization, etc., in the emulsion layer which adversely affect photographic properties.

EXAMPLE 12

24 g of gelatin was dissolved in 81 ml of distilled water, 76 ml of a 2% aqueous solution of the Dye (2)

was added, and then 178 ml of a 5% aqueous solution of the polymer dispersion Mordant 4, 64 ml of a 2% surfactant and 78 ml of an emulsion of photographic additives were added, after which the total volume of the mixture was adjusted to 500 ml. The mixture was coated as a filter layer between a green light sensitive emulsion layer and a red light sensitive emulsion layer in a photographic material.

The sample obtained was tested for adhesion in the similar manner as those in Examples 1 to 11 and showed a good adhesion by not being peeled off by the adhesive tape.

EXAMPLES 13–14 AND COMPARISON EXAMPLES 6–7

Samples illustrated below were prepared in a manner similar to Examples 1–11 above.

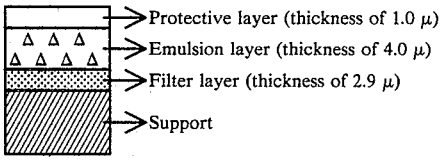

That is, coating solutions each having compositions set forth in Table 2 below were prepared.

TABLE 2

Composition of Coating Solution for Filter Layer

| | Example 13 | Example 14 | Comparison Example 6 | Comparison Example 7 |
|---|---|---|---|---|
| Gelatin | 12 g | 12 g | 12 g | 12 g |
| Distilled Water | 192 ml | 192 ml | 192 ml | 192 ml |
| Dye (2)*1 (2% aqueous sol.) | 33 ml | 33 ml | 33 ml | 33 ml |
| Emulsifying agent (1)*2 (3% aqueous sol.) | 33 ml | 33 ml | 33 ml | 33 ml |
| Mordant | Mordant 4*3 | Mordant 5*4 | Comparison Mordant 6*5 | Comparison Mordant 7*6 |
| | 13 g | 18 g | 25 g | 14 g |
| Distilled Water | 17 ml | 12 ml | 5 ml | 16 ml |

*1Dye (2):

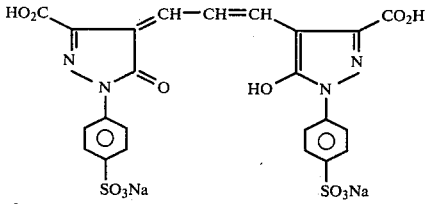

*2Emulsifying agent (1):

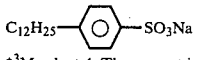

*3Mordant 4: The present invention (solid concentration of 17.7% by wt., mordant site of 4.86 × $10^{-4}$ eq/g)

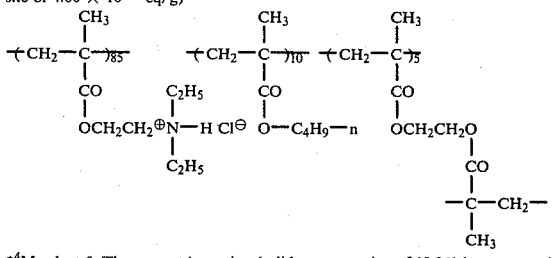

*4Mordant 5: The present invention (solid concentration of 12.2% by wt., mordant site of 3.58 × $10^{-4}$ eq/g)

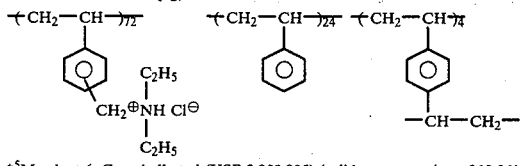

*5Mordant 6: Campbell et al (USP 3,958,995) (solid concentration of 12.2% by wt., mordant site of 2.49 × $10^{-4}$ eq/g)

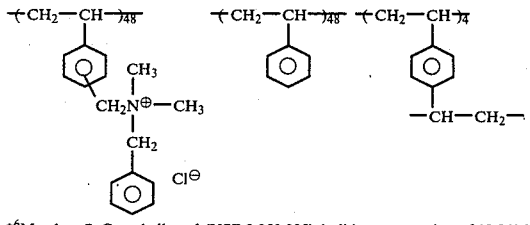

*6Mordant 7: Campbell et al (USP 3,958,995) (solid concentration of 12.0% by wt., mordant site of 4.65 × $10^{-4}$ eq/g)

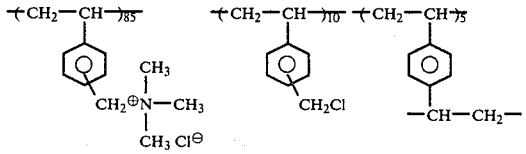

Undercoated triacetate fiber film were coated with the coating solutions above respectively so as to give a thickness after drying of about 2.9μ and dried, after which each film was coated with a green light sensitive reversal silver iodobromide emulsion layer containing an emulsion of Coupler (1)(*7) and a gelatin layer successively to give a thickness after drying of 4.0μ and 1.0μ, respectively.

In each filter layer of the above samples, ratios of Dye (2) to the mordant site of the mordant were the same.

*7 Coupler (1):

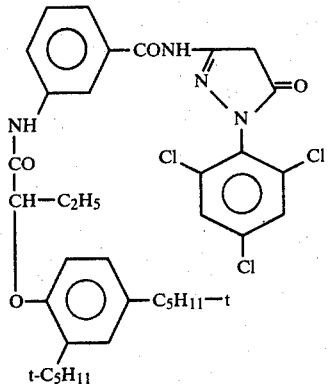

The resulting samples were exposed with white light and then treated with following reversal processings.

| | Processing | Temperature (°C.) | Time (minutes) |
|---|---|---|---|
| 1 | First Development | 38 | 3 |
| 2 | Washing | 38 | 1 |
| 3 | Reversing | 38 | 2 |
| 4 | Color development | 38 | 6 |
| 5 | Stopping | 38 | 2 |
| 6 | Bleaching | 38 | 6 |
| 7 | Fixing | 38 | 4 |
| 8 | Washing | 38 | 4 |
| 9 | Stabilizing | 38 | 1 |
| 10 | Drying | | |

The processing solution above have following compositions.

| | |
|---|---|
| First Developing Solution: | |
| Water | 800 ml |
| Sodium tetrapolyphosphate | 2.0 g |
| Sodium bisulfite | 8.0 g |
| Sodium sulfite | 37.0 g |
| 1-Phenyl-3-pyrazolidone | 0.35 g |
| Hydroquinone | 5.5 g |
| Sodium carbonate (monohydrate) | 28.0 g |
| Potassium bromide | 1.5 g |
| Potassium iodide | 13.0 ml |
| Sodium thiocyanate | 1.4 g |
| Water to make | 1.0 l |
| Reversal Solution: | |
| Water | 800 ml |
| Hexasodium nitrilo-N,N,N-trimethylenephosphonic acid | 3.0 g |
| Stannous chloride (dihydrate) | 1.0 g |
| Sodium hydroxide | 8.0 g |
| Glacial acetic acid | 15.0 ml |
| Water to make | 1.0 l |
| Color Developing Solution: | |
| Water | 800 ml |
| Sodium tetrapolyphosphate | 2.0 g |
| Benzyl alcohol | 5.0 ml |
| Sodium sulfite | 7.5 g |
| Sodium tertiary phosphate (12 hydrate) | 36.0 g |
| Potassium bromide | 1.0 g |
| Potassium iodide | 90.0 ml |
| Sodium hydroxide | 3.0 g |
| Citrazinic acid | 1.5 g |
| 4-Amino-3-methyl-N-ethyl-β-hydroxyethylaniline sesquisulphate monohydrate | 11.0 g |
| Ethylenediamine | 3.0 g |
| Water to make | 1.0 l |
| Stopping Solution: | |
| Water | 800 ml |

-continued

| | |
|---|---|
| Glacial acetic acid | 5.0 ml |
| Sodium hydroxide | 3.0 g |
| Dimethylaminoethane isothiourea (dihydrochloric acid salt) | 1.0 g |
| Water to make | 1.0 l |
| Bleaching Solution: | |
| Water | 800 ml |
| Sodium ethylenediamine tetraacetic acid (dihydrate) | 2.0 g |
| Ammonium ethylenediamine tetraacetic acid iron (III) (dihydrate) | 120.0 g |
| Potassium Bromide | 100.0 g |
| Water to make | 1.0 l |
| Fixing Solution: | |
| Water | 800 ml |
| Ammonium thiosulfate | 5.0 g |
| Sodium bisulfite | 5.0 g |
| Water to make | 1.0 l |
| Stabilizing Bath: | |
| Water | 800 ml |
| Formalin (37% aq. soln.) | 5.0 ml |
| Fuji Dri Wel | 5.0 ml |
| Water to make | 1.0 l |

Density of magenta color by the Dye (2) was measured and the results are shown in Table 3 below.

TABLE 3

| Magenta density after development processing | | | |
|---|---|---|---|
| Example 13 | Example 14 | Comparison Example 6 | Comparison Example 7 |
| 0.03 | 0.04 | 0.50 | 0.48 |

The mordants of the present invention used in Examples 13 and 14 have a hydrochloric acid salt of tertiary amine as the mordant site and, mordanting ability of the mordants of the present invention was disappeared by an alkali of the development processing solution. Thus, Dye (2) can be completely removed from the filter layer. Therefore, there was no magenta color stain which adversely affect photographic properties. This is understood from the following Figure.

FIGURE

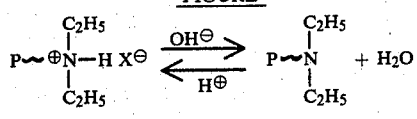

[having mordanting ability] [not having mordanting ability]

In contrast, since the mordants of Campbell have a quaternary ammonium salt as the mordant site, the mordanting ability of the mordants of Campbell does not disappeared by an alkali of the development processing solution. Thus, Dye (2) is still fixed and remained in the filter layer after processing. Therefore, there is magenta color stain which adversely affect photographic properties.

Thus, the mordant of the present invention having a tertiary amine salt as the mordant site has a function of demordanting a dye which is unnecessary after development processing. On the other hand, the mordant of Campbell having a quaternary amine salt as the mordant site does not have the above function.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising at least one gelatino layer containing a polymer dispersion of the following formula (I) or (II) as a mordant capable of mordanting an acid dye, which material is subjected to alkali processing to remove mordanted acid dye

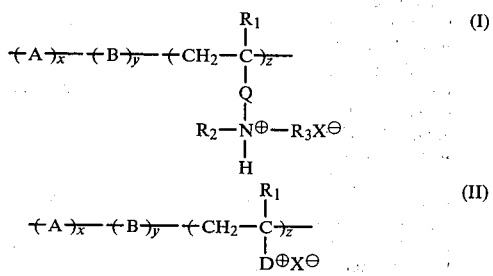

where A represents a monomer unit obtained from at least one monomer having at least two copolymerizable ethylenically unsaturated groups at least one of which is in the side chain; B represents a monomer unit obtained from at least one copolymerizable monoethylenically unsaturated monomer; $D^{\oplus}$ represents a 5- or 6-membered heterocyclic ring containing one or two nitrogen atoms one of which is positively charged to form a tertiary ammonium group and D may contain one or more substituents; $R_1$ represents a hydrogen atom or a lower alkyl group; $R_2$ and $R_3$, which may be the same or different, each represents an alkyl group or an aralkyl group, or $R_2$ and $R_3$ combine together with the nitrogen atom to which they are attached and form a 5- or 6-membered ring; $X^{\ominus}$ represents an anion; Q represents an alkylene group, a phenylene group, an aralkylene group or a group of the formula

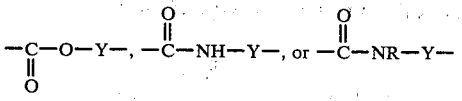

wherein Y represents the alkylene group or an aralkylene group and R represents an alkyl group; and x, y and z represent the molar percentage of the respective units in the polymer and x is about 0.5 to 10%, y is about 0 to 60% and z is about 30 to 99.5%.

2. The photographic light-sensitive material of claim 1, wherein A represents a monomer unit obtained from a dimethacrylate, a diacrylate or divinyl benzene.

3. The photographic light-sensitive material of claim 1, wherein monomer B is obtained from an α-olefin having 3 to 6 carbon atoms, styrene, α-methylstyrene, vinyltoluene, monoethylenically unsaturated esters of aliphatic acids having 2 to 6 carbon atoms, esters of monoethylenically unsaturated carboxylic acids or dicarboxylic acids having 3 to 20 carbon atoms, styrene or a derivatives thereof, acrylonitrile, and allyl cyanide.

4. The photographic light-sensitive material of claim 2, wherein the unit A is obtained from divinyl benzene or ethylene glycol dimethacrylate.

5. The photographic light-sensitive material of claim 3, wherein unit B is obtained from styrene, n-butylmethacrylate, cyclohexyl methacrylate.

6. The photographic light-sensitive material of claim 1, wherein D represents a ring selected from the following:

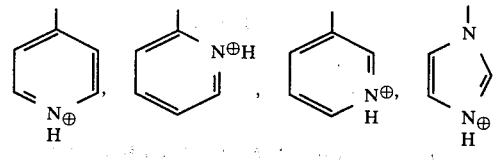

7. The photographic light-sensitive material of claim 1, wherein x is about 3 to 10 mol%, y is about 0 to 55 mol%, and z is about 40 to 97 mol%.

8. The photographic light-sensitive material of claim 1, wherein said polymer of the formula (I) or (II) is present in said layer in an amount of about 2 to 10 g per 100 g of dry gelatin.

9. The photographic light-sensitive material of claim 1, wherein said layer is an antihalation layer.

10. The photographic light-sensitive material of claim 1, wherein said layer is a filter layer.

11. The photographic light-sensitive material of claim 1, wherein said mordant has general formula (II).

12. The photographic light-sensitive material of claim 1, wherein said mordant has general formula (I).

13. The photographic light-sensitive material of claim 12, wherein monomer A contains 4 to 20 carbon atoms, monomer B contains 3 to 20 carbon atoms, Q is a divalent alkylene group having 1 to 12 carbon atoms, a phenylene group or an aralkylene group having 7 to 12 carbon atoms, $R_1$ is a hydrogen atom or a lower straight chain alkyl group having 1 to 6 carbon atoms and wherein $R_2$ and $R_3$, which may be the same or different, each represents a straight, branched or cyclic alkyl group having 1 to 20 carbon atoms or a mono- or bicyclic aralkyl group having 7 to 20 carbon atoms.

14. The photographic light-sensitive material of claim 13, wherein $X^{\ominus}$ is selected from the group consisting of a halogen atom, an alkyl- or aryl-sulfonate ion, an acetate ion, a nitrate ion, a sulfate ion or a phosphate ion.

15. The photographic light-sensitive material of claim 14, wherein said mordant is utilized in an amount of about 2 to 100 g of mordant per 100 g of dry gelatin.

16. The photographic light-sensitive material of claim 15, wherein said mordant is in a filter layer or an antihalation layer.

17. The photographic light-sensitive material of claim 1, wherein said acid dye is selected from acid dyes comprising a sulfonyl group, a carboxyl group, a sulfonamido group or a phenolic hydroxyl group.

* * * * *